US005309208A

United States Patent [19]

Bean et al.

[11] Patent Number: 5,309,208

[45] Date of Patent: May 3, 1994

[54] METHOD AND DEVICE FOR ELIMINATING TONER LEAKAGE FROM A TONER CARTRIDGE

[75] Inventors: Lloyd F. Bean, Rochester; Victor Berko-Boateng, Penfield; Thomas R. Race, Rochester, all of N.Y.

[73] Assignee: Xerox Corporation, Stamford, Conn.

[21] Appl. No.: 983,929

[22] Filed: Dec. 1, 1992

[51] Int. Cl.[5] ..... G03G 15/06

[52] U.S. Cl. ..... 355/260; 141/364; 141/366; 141/386; 220/264; 222/541; 222/DIG. 1

[58] Field of Search ..... 355/245, 260; 118/653; 141/364–366, 375, 386, 312; 222/325, 510, 541, DIG. 1; 220/263, 264

[56] References Cited

U.S. PATENT DOCUMENTS

| | | | |
|---|---|---|---|
| 4,039,102 | 8/1977 | Klett | 222/38 |
| 4,583,832 | 4/1986 | Kasamura et al. | 355/260 |
| 4,615,364 | 10/1986 | Kawata | 141/364 |
| 4,627,476 | 12/1986 | Wilcke | 141/364 |
| 4,930,684 | 6/1990 | Patterson | 222/325 |
| 4,942,432 | 7/1990 | Mort et al. | 355/260 |
| 4,961,450 | 10/1990 | Furuta | 355/260 |

FOREIGN PATENT DOCUMENTS

| | | | |
|---|---|---|---|
| 0186284 | 8/1987 | Japan | 355/260 |
| 0032574 | 2/1988 | Japan | 355/260 |
| 0080281 | 4/1988 | Japan | 355/260 |
| 0106084 | 4/1989 | Japan | 355/260 |
| 0178672 | 6/1992 | Japan | 355/260 |
| 2112363 | 7/1983 | United Kingdom | 141/364 |

*Primary Examiner*—A. T. Grimley
*Assistant Examiner*—William J. Royer
*Attorney, Agent, or Firm*—Kenyon & Kenyon

[57] ABSTRACT

A toner cartridge for use with a copier having a toner hopper with a first interlocking seal including a second interlocking seal being specially adapted to mate with the first interlocking seal of the toner hopper, a hinged movable panel being disposed at the bottom portion of the toner cartridge, a movable panel, seal and a filament for manipulating the movable panel.

44 Claims, 9 Drawing Sheets

METHOD AND DEVICE FOR ELIMINATING TONER LEAKAGE FROM A TONER CARTRIDGE

BACKGROUND OF THE INVENTION

The present invention relates to toner cartridges and more particularly to a toner cartridge specially adapted to minimize or prevent toner leakage during use and to permit "white glove" installation and removal of the toner cartridge onto and from a toner hopper.

In conventional copying, a transfer plate comprising a layer of photosensitive insulating material affixed to a conductive backing is used to support electrostatic latent images. In the copying process, the photosensitive surface is electrostatically charged and the charged surface is then exposed to a light pattern of the image being reproduced to thereby discharge the surface in the areas where light strikes the surface. The non-discharged areas of the surface thus form an electrostatic charge pattern (an electrostatic latent image) corresponding to the original pattern. The latent image is then developed by contacting it with a finely divided electrostatically attractable powder referred to as toner. The electrostatic charge holds the toner on the image areas. Where the charge is greater, a greater amount of toner is deposited. With this system, the toner image produced corresponds to the light image of the copy being reproduced. Usually, the developed image is then transferred to a suitable transfer member (e.g., paper) and the image is affixed thereto to form a permanent record of the original document.

Since a quantity of the toner is consumed with each copy, new toner must be added periodically to replenish toner spent in making copies. Toner for this purpose is typically carried in a toner cartridge that can be installed into the copier apparatus. The toner cartridge can be installed onto a toner hopper (i.e., the interface of a toner sump or toner bin which forms a reservoir adapted to accept and hold the toner). When copies are made, a developer roll transports tribo-electrically charged toner from the toner bin to the transfer plate.

Molding processes used in the past created toner cartridges having uneven wall thicknesses. This was especially true at the flange portion of the toner cartridge, i.e., the surface area of the toner cartridge contacting the toner hopper of a copier. Since the surface of the flanges of the toner cartridge were uneven, gaps would exist between the flange surface and the mating surface of the toner hopper. As a result, toner would spill or leak into the immediate area. The inherent vibrations existing in copier machine operation magnified this problem. Moreover, such gaps permit foreign materials to enter the toner hopper area and contaminate the held toner.

In addition to overcoming the problem of leakage, facility maintenance and replacement is a constant concern of copier manufactures. In addition, copier firms as well as firms providing routine copier maintenance and servicing must be accomplished to satisfy customers by providing quick service at low cost with acceptable results. In the past, the seal of the toner cartridge was removed immediately prior to inserting the toner cartridge on to the toner hopper creating the possibility of spilling toner. Such spills are obviously unacceptable in most facilities where copiers are used.

SUMMARY OF THE INVENTION

The present invention overcomes the problem of unacceptable toner leakage existing in conventional toner cartridges. The leakage is minimized or eliminated by providing a unique sealing feature at the interface of the toner delivery system and the replaceable toner cartridge. Interlocking sealing means are provided on complementary parts of the toner cartridge and the mating area of the toner drain (i.e., hopper), of the toner delivery system so that when the toner cartridge is mounted to the toner hopper, a positive seal can be formed between these two elements. This permits passage of toner from the cartridge to the hopper without spillage.

In a preferred embodiment, the interlocking sealing means are formed from soft poly-vinyl-chloride (PVC) so as to have a rubber-like hardness. The interlocking sealing means may also be formed from low density polyethylene (LDPE) or a rubber such as SANTOPRENE TM (DUROMETER 73 TM). In addition, the mating surfaces of the interlocking sealing means are formed to provide an interference fit while being sufficiently flexible to permit the operator to interlock the cartridge in place on the hopper.

In an alternate embodiment, interlocking sealing means include a rectangular extension and flange, on the cartridge which forms a friction seal with a similar extension on the toner hopper thereby forming a sealed path between the toner hopper and the toner cartridge. For friction fits of this type, an additional mechanism is employed to secure the cartridge in place. In the specified embodiment described rotatable clamps are located on the toner drain housing (hopper), positioned to clamp the toner cartridge to the hopper.

The present invention also permits "white-glove" handling of the toner cartridge when inserting the toner cartridge onto, or removing the toner cartridge from the toner hopper. In a first embodiment, the present invention does so by providing the toner cartridge with a movable panel (e.g., a hinged panel), means for sealing the movable panel (e.g., tape) initially holding the movable panel in a closed position, and a long, thin, flexible member (e.g., a filament and in particular string) provided beneath the means for sealing the movable panel, having one end attached to the movable panel, and having another end exiting through a small hole in the top of the toner cartridge. When the toner cartridge is installed onto the toner hopper, the respective interlocking sealing means of each form a positive seal, and/or the clamps are positioned to clamp the toner cartridge to the toner hopper as mentioned above. The long, thin, flexible member is then pulled to cut or break the means for sealing the movable panel thereby releasing the movable panel. The movable panel opens as a result of the force provided by its own weight and by the weight of any toner above it. Only then is toner in the toner cartridge released and permitted to flow into the toner hopper. When removing the toner cartridge, the long, thin, flexible member exiting through the small hole in the top of the toner cartridge is first pulled thereby closing the movable panel such that the flow of toner to the toner hopper ceases and by pulling the long, thin, flexible member further, the toner is sealed in the toner cartridge. The toner cartridge is then tipped so that the seal formed by the interlocking sealing means may be broken and the toner cartridge may be removed.

In an alternate embodiment, the movable panel is provided with an axis rather than a hinge and may be opened and held closed by rotating a mechanical interlock in place of the long, thin, flexible member.

In a further alternate embodiment of the movable panel, the movable panel is slidable and has an open position, and a sealed, closed position.

BRIEF DESCRIPTION OF THE DRAWING

FIG. 2*c* illustrates a cross-sectional front end view of the alternate embodiment of the present invention shown in FIGS. 2*a* and 2*b*. To simplify this figure, the interlocking sealing means of the toner cartridge and toner hopper are not shown.

FIG. 2*d* illustrates a cross-sectional side view of the alternate embodiment of the present invention shown in FIGS. 2*a* and 2*b*. To simplify this figure, the interlocking sealing means of the toner cartridge and toner hopper are not shown.

FIGS. 3(*b*) and 3(*c*) are a perspective view and a side view, respectively, of an alternate clamping means.

DETAILED DESCRIPTION

Figure 1A:
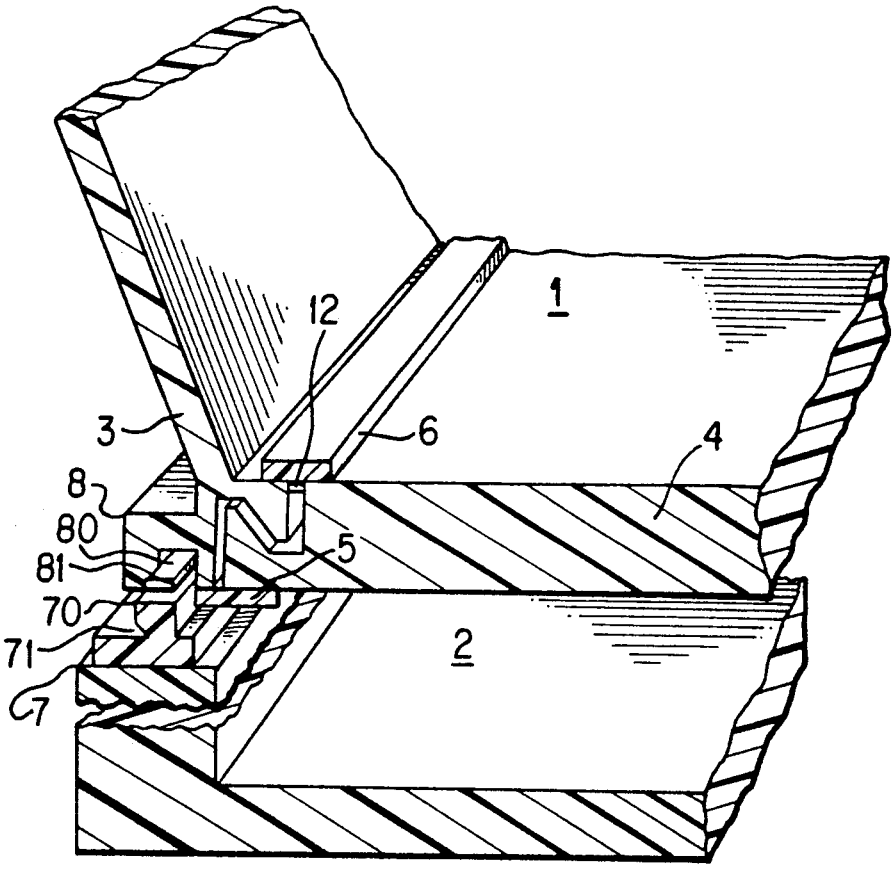
FIG. 1*a* is a cross section of a partial perspective view of the sealing area of the toner hopper and of the sealing area of the toner cartridge of the present invention.

FIG. 1*a* is a cross section of a partial perspective view of the sealing area of the toner hopper and the sealing area of the toner cartridge of the present invention. A portion of the toner cartridge 1 is shown over the interlocking sealing means mount 7 of the toner hopper 2. The toner cartridge is provided with a plurality (e.g., four) of side walls 3 to contain the toner. These side walls are provided, at their bottom region, with a interlocking sealing means groove 8 (female interlocking sealing means) corresponding to the interlocking sealing means mount 7 (male interlocking sealing means) of the toner hopper 2.

Typical interlocking sealing means are made of hard plastic having slightly curved mating surfaces. While such an interlocking sealing means may be used in the present invention, providing a flexible interlocking sealing means with substantially flat and parallel mating surfaces 70 and 80 having a rubber-like hardness better suits the toner cartridge/hopper arrangement. Such a rubber-like hardness can be attained by forming the interlocking sealing means of a soft PVC. Other suitable materials include low density polyethylene (LDPE) and rubbers such as SANTOPRENE TM (e.g., DUROMETER 73 TM). In a preferred embodiment, the interlocking sealing means groove 8 includes a slight extension 81 on at least one of its inner side walls. This slight extension 81 fits into a corresponding void 71 formed in at least one of the outer side walls of the interlocking sealing means mount 7. With such an arrangement the seal remains secure even after being subjected to vibrations.

In an alternate embodiment, the toner cartridge can be provided with a interlocking sealing means mount (male interlocking sealing means) and the toner hopper can be provided with an interlocking sealing means groove (female interlocking sealing means). In a preferred embodiment, at least one of the mating surfaces is flexible and conformable.

In each of the embodiments, the surface of the interlocking sealing means is automatically cleaned as the seal is being formed.

Figure 4:
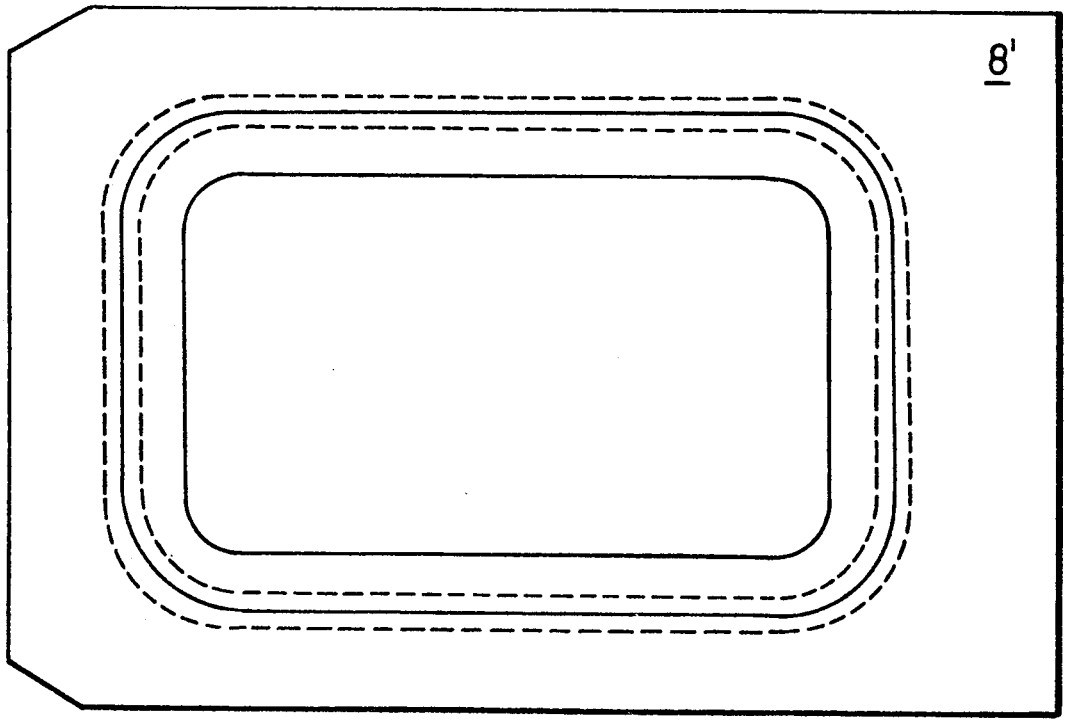
FIG. 4 is a top view of a mount of a interlocking sealing means of a toner cartridge according to an alternate embodiment of the present invention.
Figure 3B:
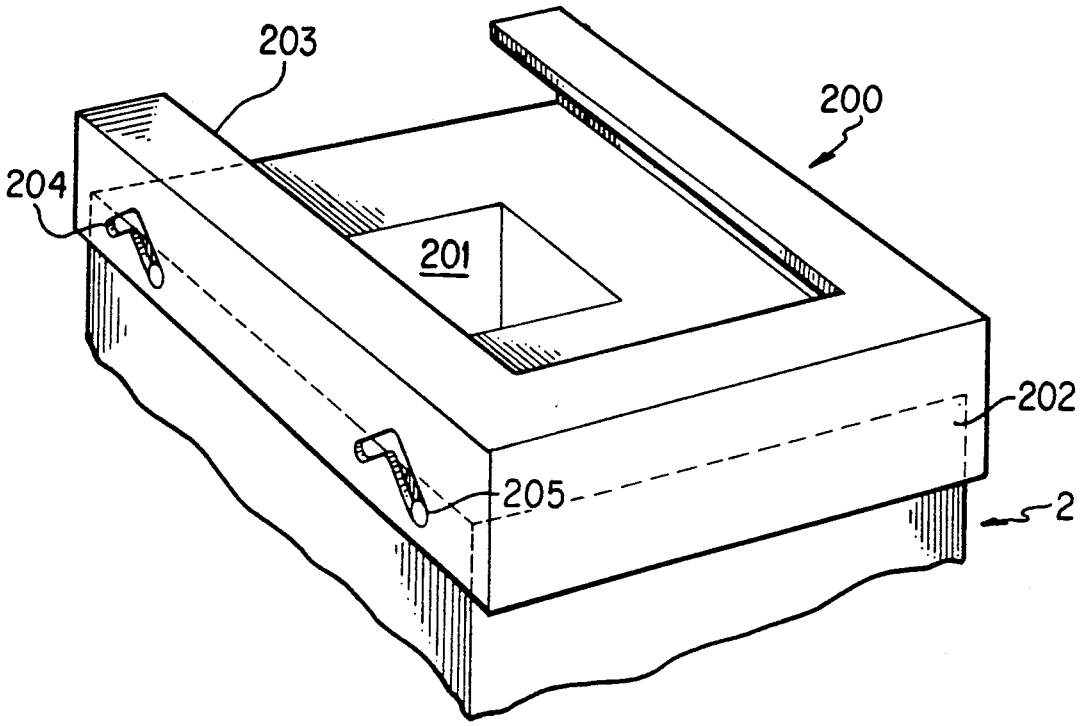
Figure 3C:
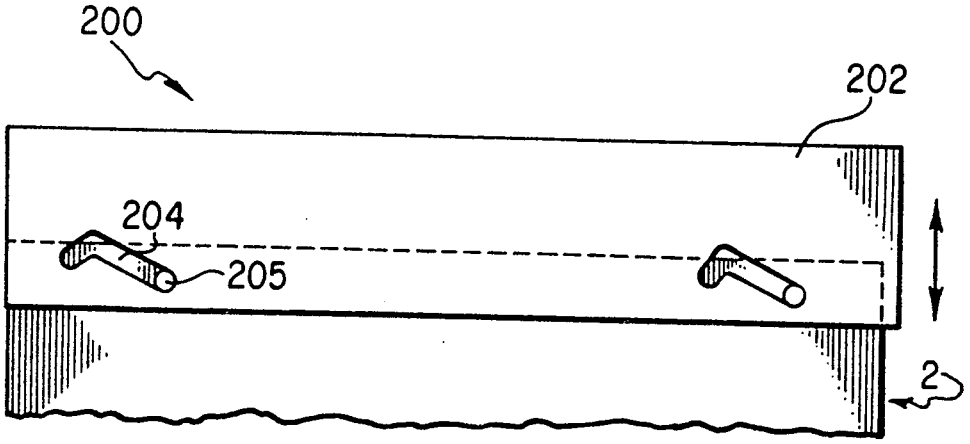

In a further alternate embodiment illustrated in FIGS. 4–7, male and female interlocking sealing means are not used. FIG. 4 shows a top view of such a toner cartridge interlocking sealing means 8', while FIG. 5*a* shows a cross-sectional side view of the toner cartridge interlocking sealing means 8'. A rectangular flange portion 43 is disposed adjacent to, and outside the periphery of, a rectangular extension 44.

Figure 5A:
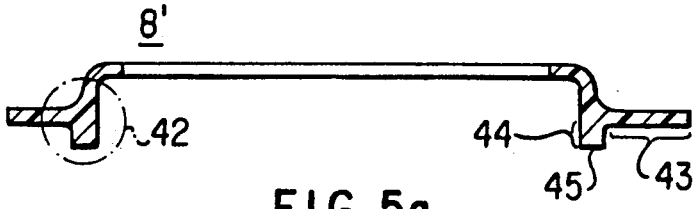
FIG. 5*a* is a cross-sectional side view of the toner cartridge interlocking sealing means mount shown in FIG. 4.
Figure 6:
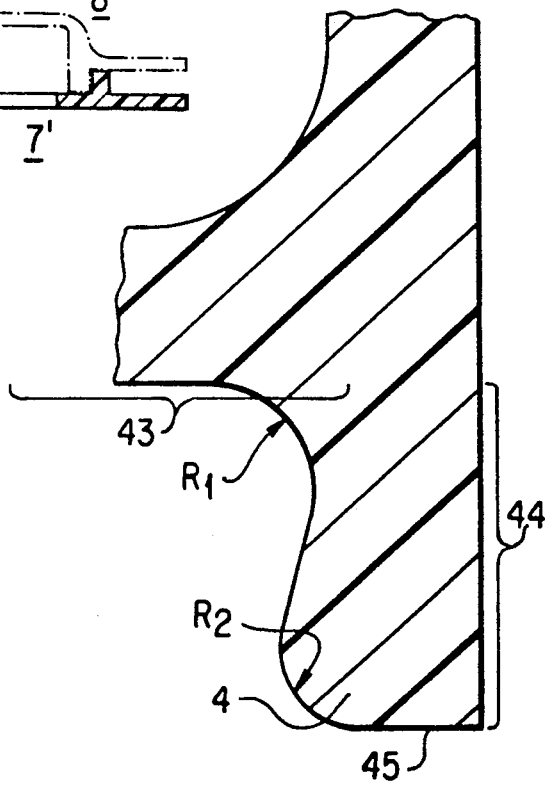
FIG. 6 is a magnified view of the circled portion of FIG. 5*a*.

FIG. 6 is a magnified cross-sectional view of the circled portion 42 of the toner cartridge interlocking sealing means 8' of FIG. 5*a*. As shown in FIG. 6, the outside part of the rectangular extension 44 joins the rectangular flange 43 forming a radius of curvature $R_1$ of between 0.04 and 0.08 inches and preferably between 0.055 and 0.065 inches. Further, as shown in FIG. 6, the cross-section of the rectangular extension 44 widens as it progresses from the rectangular flange 43. The bottom edge 45 of the rectangular extension 44 forms a radius of curvature $R_2$ of between 0.03 and 0.06 inches, and preferably between 0.04 and 0.05 inches, with the side of the rectangular extension 44 adjacent to the rectangular flange 43 (i.e., the outer side of 44).

Figure 5B:
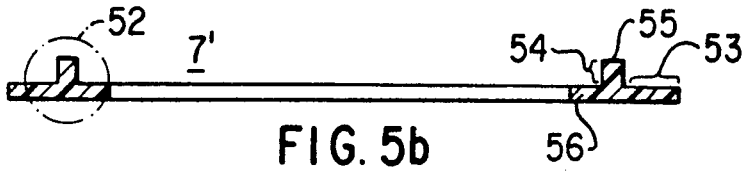
FIG. 5*b* is a cross-sectional side view of a mount of a interlocking sealing means of a toner hopper according to an alternate embodiment of the present invention.
Figure 5C:
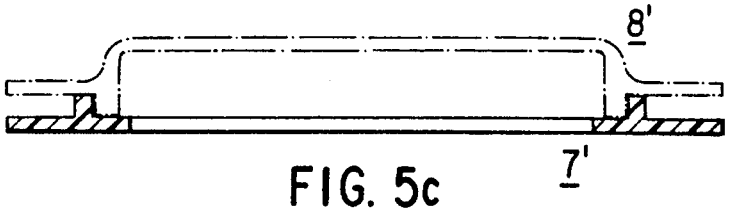
FIG. 5*c* is a cross-sectional side view illustrating the relationship of the toner cartridge interlocking sealing means with the interlocking sealing means of the toner hopper.

FIG. 5*b* shows a cross-sectional side view of the toner hopper interlocking sealing means 7'. An outer rectangular flange portion 53 and an inner rectangular flange portion 56 are disposed adjacent to the periphery of a rectangular extension 54. The inner length and width of the rectangular extension 54 of the toner hopper interlocking sealing means are approximately equal to the outer length and width, respectively, of the rectangular extension 44 of the toner cartridge interlocking sealing means 8'. The toner cartridge interlocking sealing means 8' is shown in fantom to illustrate the arrangement between it and the toner hopper interlocking sealing means in FIG. 5*c*.

Figure 7:
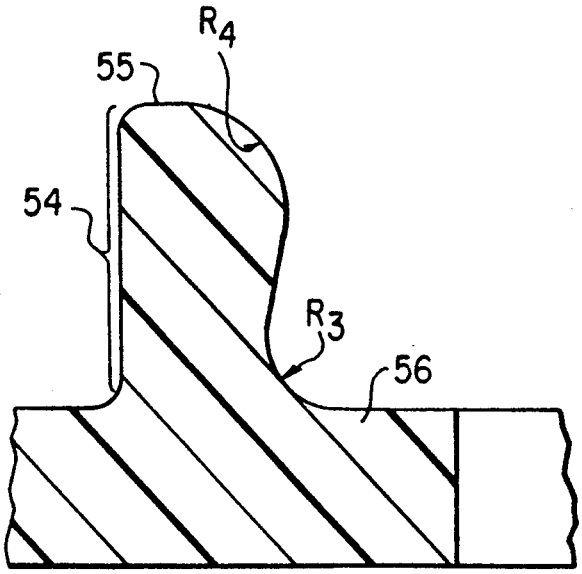
FIG. 7 is a magnified view of the circled portion of FIG. 5*b*.

FIG. 7 is a magnified cross-sectional view of the circle portion 52 of the toner hopper interlocking sealing means 7' of FIG. 5*b*. As shown in FIG. 7, the inside part of the rectangular extension 54 joins the inner rectangular flange 56 forming a radius of curvature $R_3$ of between 0.03 and 0.06 inches and preferably between 0.04 and 0.05 inches, such that $R_3$ is approximately equal to $R_2$.

Further, as shown in FIG. 7, the cross-section of the rectangular extension 54 widens as it progresses from the outer rectangular flange 53. The top edge 55 of the rectangular extension 54 forms a radius of curvature $R_4$ of between 0.03 and 0.06 inches and preferably 0.04 and 0.05 inches with the side of the rectangular extension 54 adjacent to the inner rectangular flange 56 (i.e., the inner side of 54).

Figure 2A:
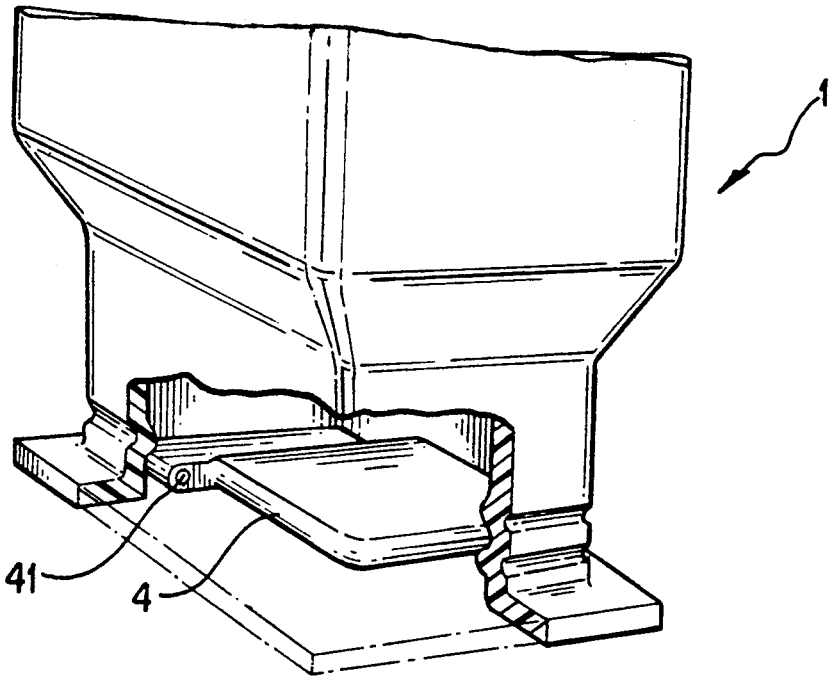
FIG. 2*a* illustrates a partial cut-away perspective view of the toner cartridge in an alternate embodiment of the present invention. To simplify this figure, the interlocking sealing means of the toner cartridge is not shown.
Figure 2B:
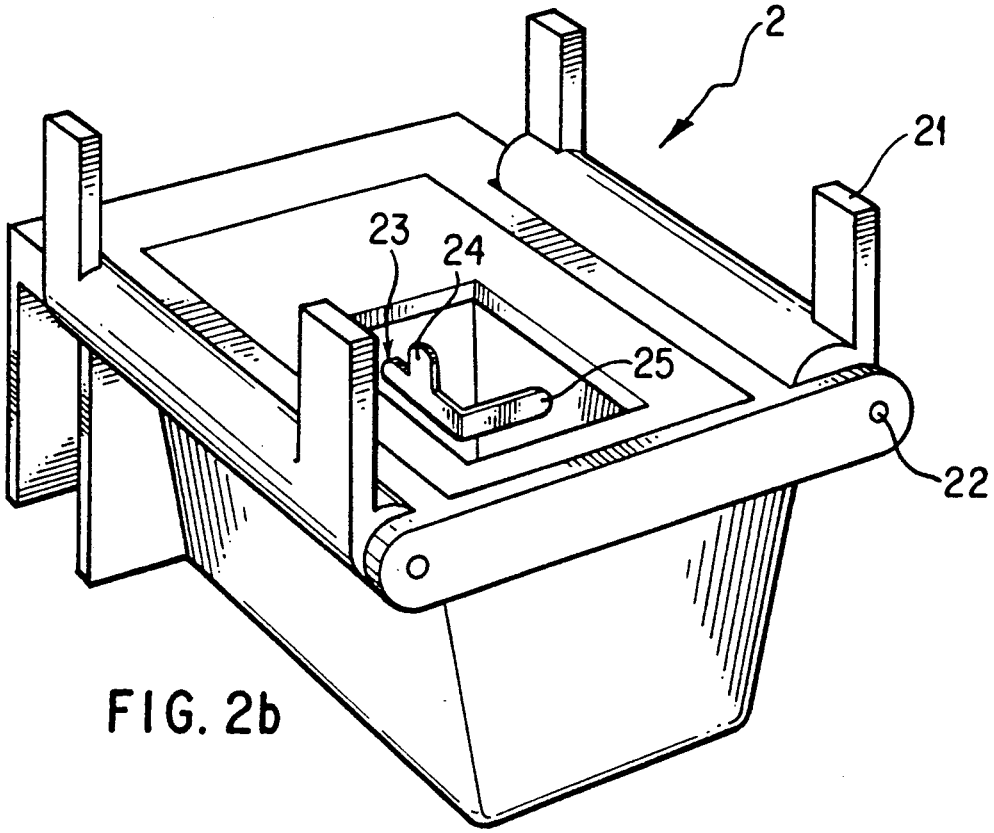
FIG. 2*b* illustrates a perspective view of the toner hopper, clamps, and mechanical interlock in the alternate embodiment of the present invention. To simplify this figure, the interlocking sealing means of the toner hopper is not shown.
Figure 3B:
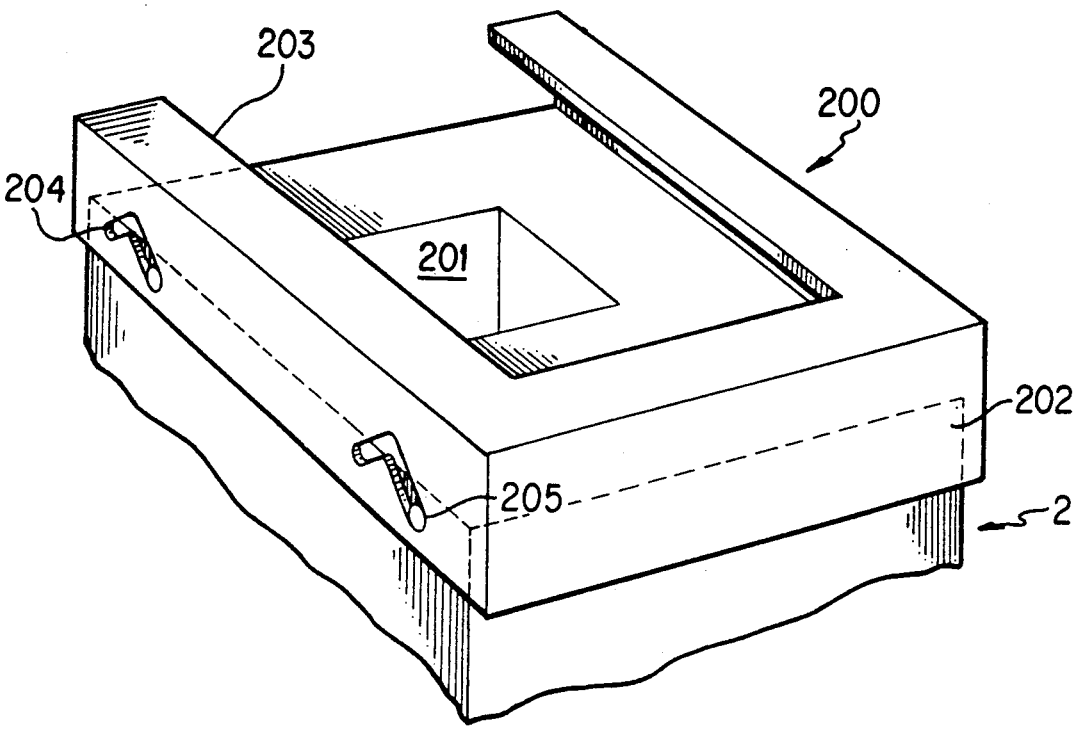
FIG. 3(*a*) illustrates a perspective view of a clamp used in the alternate embodiment of the present invention shown in FIG. 2*b*.
Figure 3C:
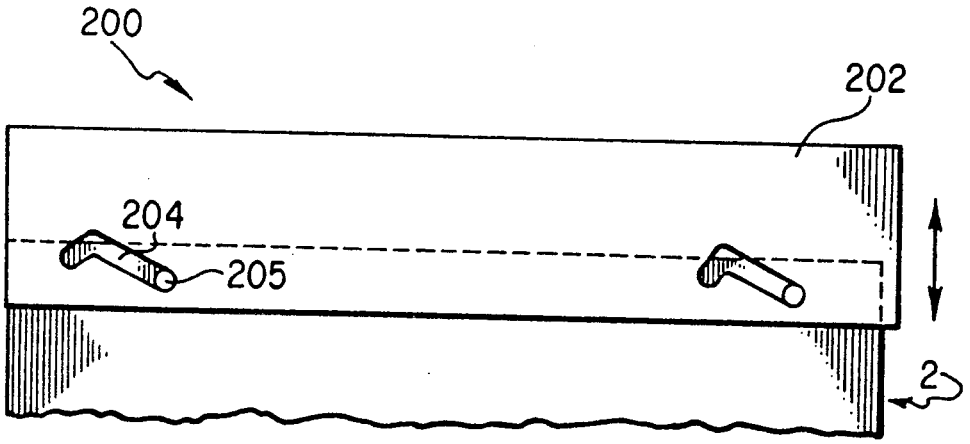
Figure 3A:
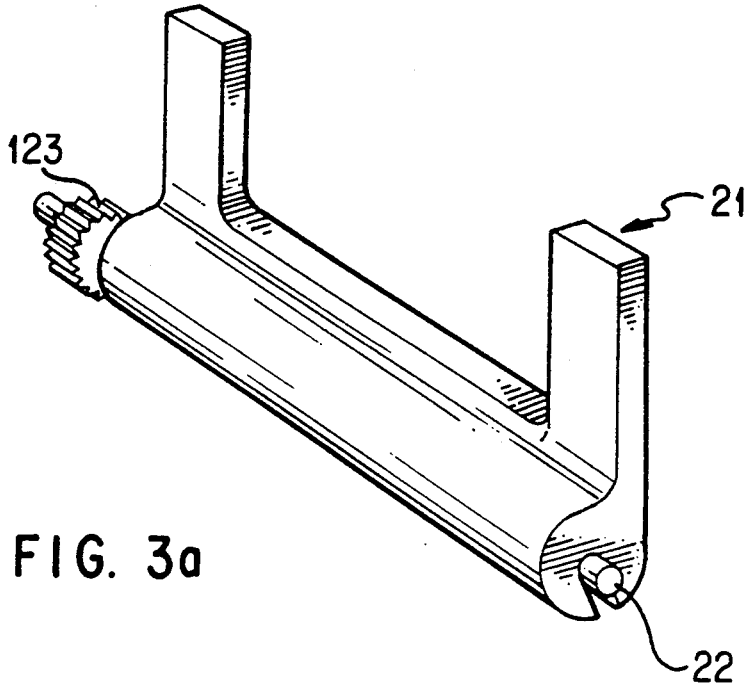

Alternately, as shown in FIGS. 2*a* and 2*b* the toner cartridge 1 can be positioned over the toner hopper 2 while clamps 21 are in a raised position. Once the toner cartridge 1 is in position, the clamps 21 are rotated about their axis 22 to assume a closed position in which the toner cartridge 1 is held to the toner hopper 2 (see FIG. 2*c*). The clamp 21 may be rotated via gear 123 (see FIG. 3(*a*)). As shown in FIG. 3(*a*), the clamp 21 includes a central portion and two extending arms which are arranged in a compressed "U" shape. The distance between the inside portions of the extending arms is roughly equal to or slightly larger than the outside dimension of opposing walls of the toner cartridge. To simplify the drawings, the interlocking sealing means of the toner cartridge 1 and toner hopper 2 are not shown.

An alternate clamping means 200 is illustrated in FIGS. 3(*b*) and 3(*c*). As shown, this alternate clamping means 200 is formed of three flat wall portions 202 connected at right angles to each other in a "U" shape arrangement. A flange portion 203 projects inward from each of the flat wall portions 202. Two opposing side walls 202 are each provided with a pair of cam slots 204. A pair of pins 205 extending from the outside surface of two opposing walls of the toner hopper 2 project through the two cam slots 204, respectively. The toner cartridge 1 is positioned on the toner hopper 2 so that its bottom is above the opening 201 of the toner hopper 2. The clamping means 200 is then moved to the right and lowered, following the cam slots 204 such that the flanges 203 clamp corresponding flanges on the bottom of the toner cartridge 1 (see FIG. 2(*a*)) against the top surface of the toner hopper 2. To simplify the drawings, the interlocking sealing means of the toner cartridge 1 and toner hopper 2 are not shown.

Figure 1B:
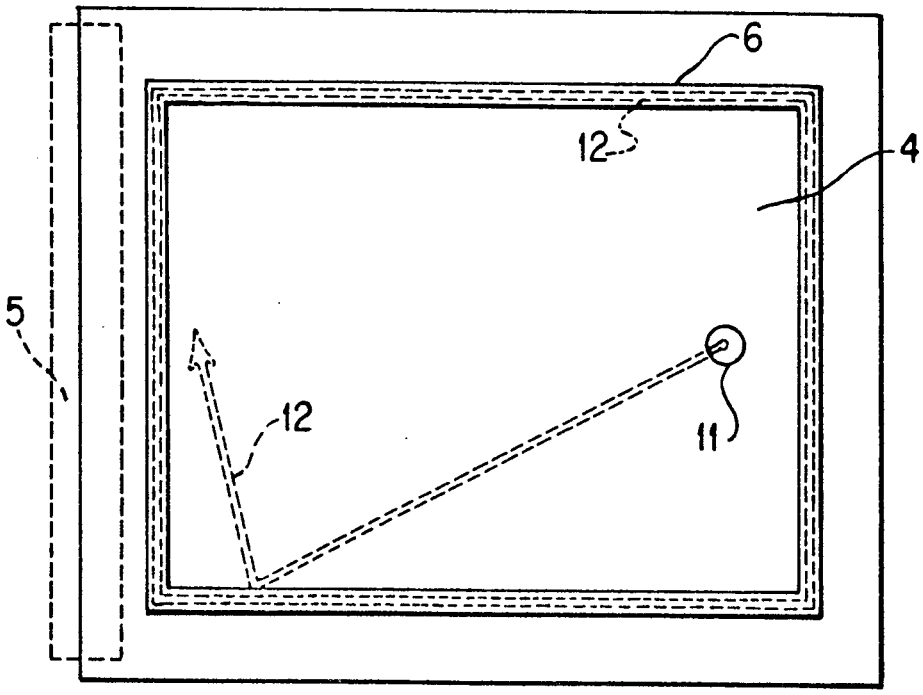
FIG. 1*b* is a top view of the hinged movable panel of the toner cartridge according to a first embodiment of the present invention.

In a first embodiment, a movable panel 4 is pivotally attached to one of the side walls 3 of the toner cartridge by a hinge 5. In a preferred embodiment, the movable panel is between 2.5 and 4.5 inches long and between 2 and 3 inches wide. The movable panel is held in a closed position, i.e., parallel to the mating surface of the toner hopper 2 (see solid lines of FIG. 1*c*), by a means for sealing the movable panel (e.g., tape) 6. Beneath the means for sealing the movable panel 6 lies a middle portion of a long, thin, flexible member (e.g., a filament, preferably string) 12. A first end of the filament 12 is connected to an attachment point 11 of the movable panel 4 (see FIG. 1*b*). A second end 9 of the filament 12 exits through a small hole 10 at the top of the toner cartridge (see FIG. 1*c*). A portion of the filament 12 in the area of the second end and outside the toner cartridge 1 is affixed to the top outer surface of the toner cartridge (e.g., by a piece of tape 13). In other words, the filament 12 has its first end connected to attachment point 11 of the movable panel 4. From there, the filament 12 heads toward the periphery of the movable panel 4, then is disposed along the periphery of the movable panel 4 under the means for sealing the movable panel 6 (see FIG. 1*b*), and then heads through a portion of the cavity formed by the side walls of the toner cartridge and out the small hole 10 through the top of the toner cartridge 1. In an alternate embodiment, two movable panels may be hinged in a "butterfly" arrangement having two filament attachment points as shown in FIG. 1*d*. The two movable panels preferably share a common hinge. However, each may be provided with its own hinge.

Figure 1C:
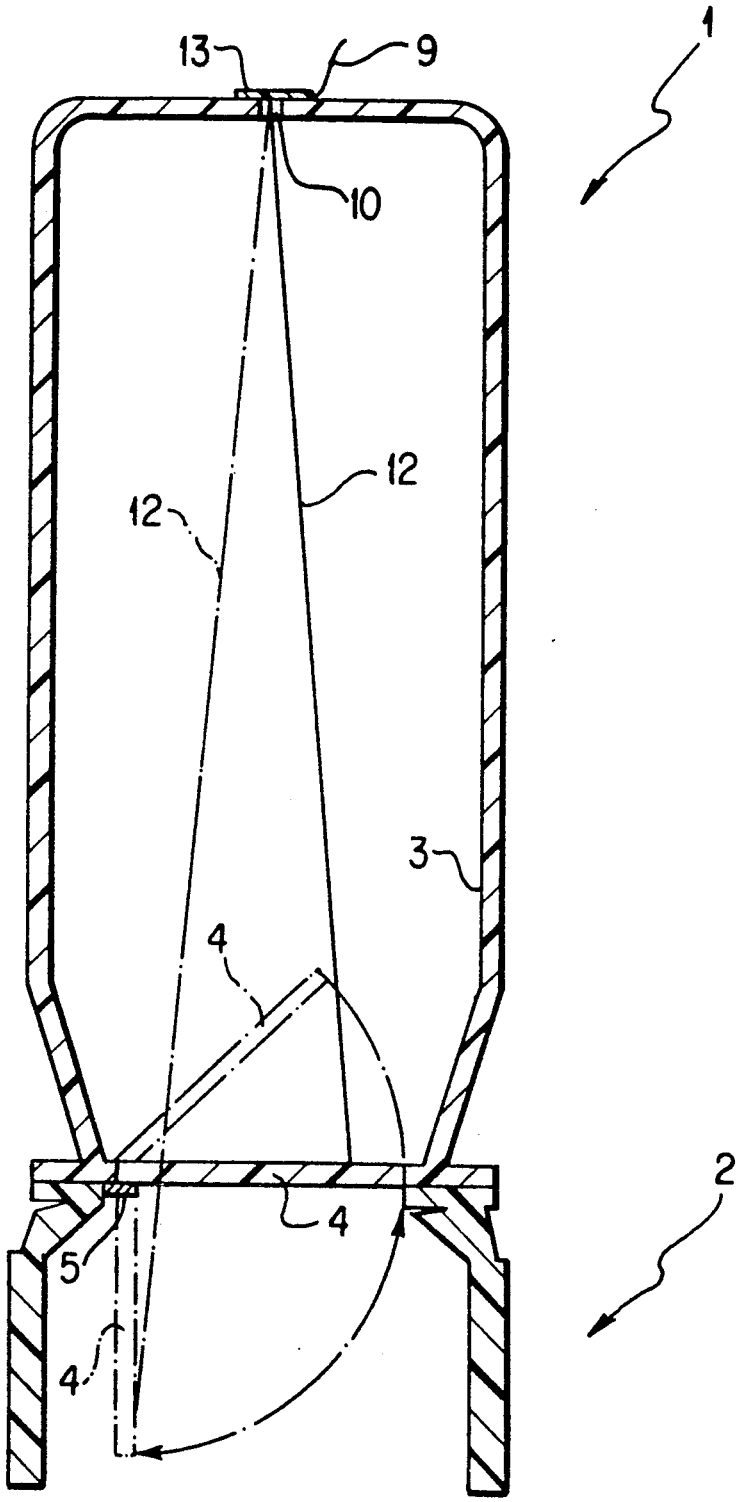
FIG. 1*c* illustrates the states of a hinged movable panel of the toner cartridge of the first embodiment of the present invention when the toner cartridge is attached to the toner hopper. To simplify this figure, the interlocking sealing means of the toner cartridge and toner hopper are not shown.
Figure 1D:
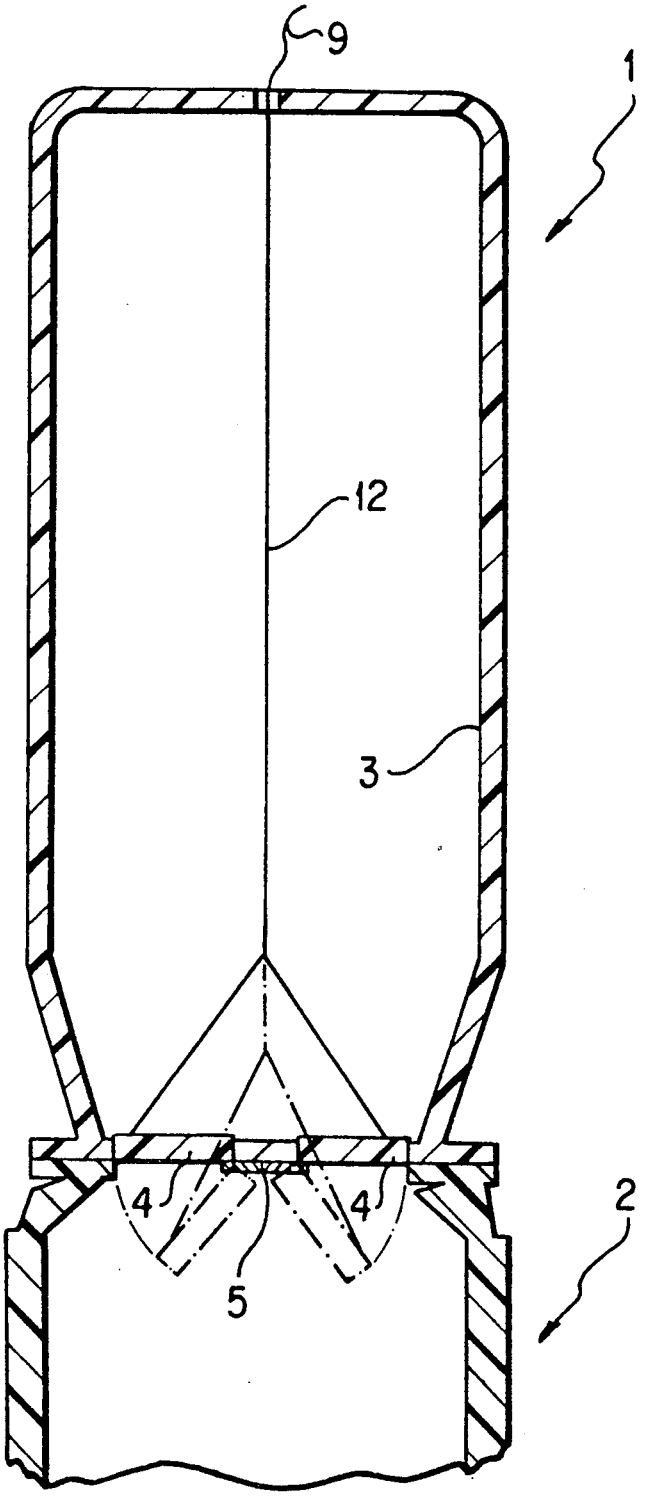
FIG. 1*d* illustrates the states of an alternate embodiment of the present invention having two hinged movable panels. To simplify this figure, the interlocking sealing means of the toner cartridge and toner hopper are not shown.

When the toner cartride 1 is mounted onto the toner hopper 2 such that the interlocking sealing means groove 8 of the toner cartridge forms a seal with the interlocking sealing means mount 7 of the toner hopper, the movable panel 4 may be opened to release the toner into the toner hopper (see dotted lines of FIGS. 1*c* and 1*d*). This is done by pulling the second end 9 of the filament 12 thereby cutting or breaking the means for sealing the movable panel 6. The movable panel is forced open by its own weight and by the weight of any toner above it.

When removing the toner cartridge 1 from the toner hopper 2 is desired, the second end 9 of the filament 12 is pulled so that the movable panel 4 is lifted into its closed position. In this way, the toner cartridge can be removed from the toner hopper without any toner leaking. This is especially advantageous when removing a toner cartridge which is not yet empty is desired.

In an alternated embodiment, two separate long, thin, flexible members (e.g., filaments, preferably strings) may be provided instead of one. That is, a first filament for cutting or breaking the means for sealing the movable panel 4 and a second, separate, filament for manipulating (i.e., opening and closing) the movable panel 4 may be provided.

In another alternate embodiment, one end of the means for sealing the movable panel 4 exits through a slit on the top of the toner cartridge. Therefore, the end of the means for sealing the movable panel 4 can be pulled to remove it rather than having the filament cut or break it thereby obviating the need for the cutting filament. However, a filament is still provided which has a first end attached at the attachment point 11 and a second end which exits the small hole 10 in the top of the toner cartridge for manipulating (i.e., opening and closing) the movable panel 4.

In a preferred embodiment, the attachment point 11 on the movable panel 4 is located at the end of the movable panel 4 opposite that of the hinge 5.

In a further alternate embodiment, in the place of a hinge, the movable panel 4 may rotate about an axis 41 which is attached, at its ends, to two opposing side walls 3 of the toner cartridge 1 (see FIGS. 2*a* and 2*d*). In this embodiment, the movable panel 4 has an upper region 42, a lower region 43, and a connecting middle region 44 (see FIG. 2*d*). As shown in FIG. 2*d*, the upper region 42 is longer than, and parallel to, the lower region 43. The middle region 44 connects the upper and lower regions and accommodates the axis 41.

The movable panel 4 is opened and closed using a mechanical interlock 23 (see FIGS. 2*b*–2*d*). The mechanical interlock 23 includes an axial portion 26, a first rod extension 24, and a second rod extension 25 (see FIGS. 2*b*–2*d*). The second rod extension 25 is longer than, and, in a preferred embodiment, roughly orthogonal to, the first rod extension 24.

As shown in FIG. 2*d*, when the movable panel 4 is in the closed position, the first rod extension 24 contacts the lower region 43 of the movable panel 4. This contact prevents the movable panel 4 from rotating counter-clockwise about its axis 41. A protrusion 28 in a sidewall 3 of the toner cartridge 1 prevents the movable panel 4 from rotating clockwise about its axis 41.

When opening the movable panel 4 is desired, the mechanical interlock 23 is rotated about its axis 26 roughly a quarter-turn clockwise (see FIG. 2*c*) such that the second rod extension 25 contacts the upper region 42 of the movable panel 4 and forces it to rotate about its axis counter-clockwise (see dashed lines of FIG. 2*d*).

In a preferred embodiment, the rotation of the mechanical interlock 23 corresponds to the rotation of the clamps 21 such that, as the clamps are lowered into their clamping position, the mechanical interlock 23 opens the movable panel 4.

Figures 8A, 8B, 8C:
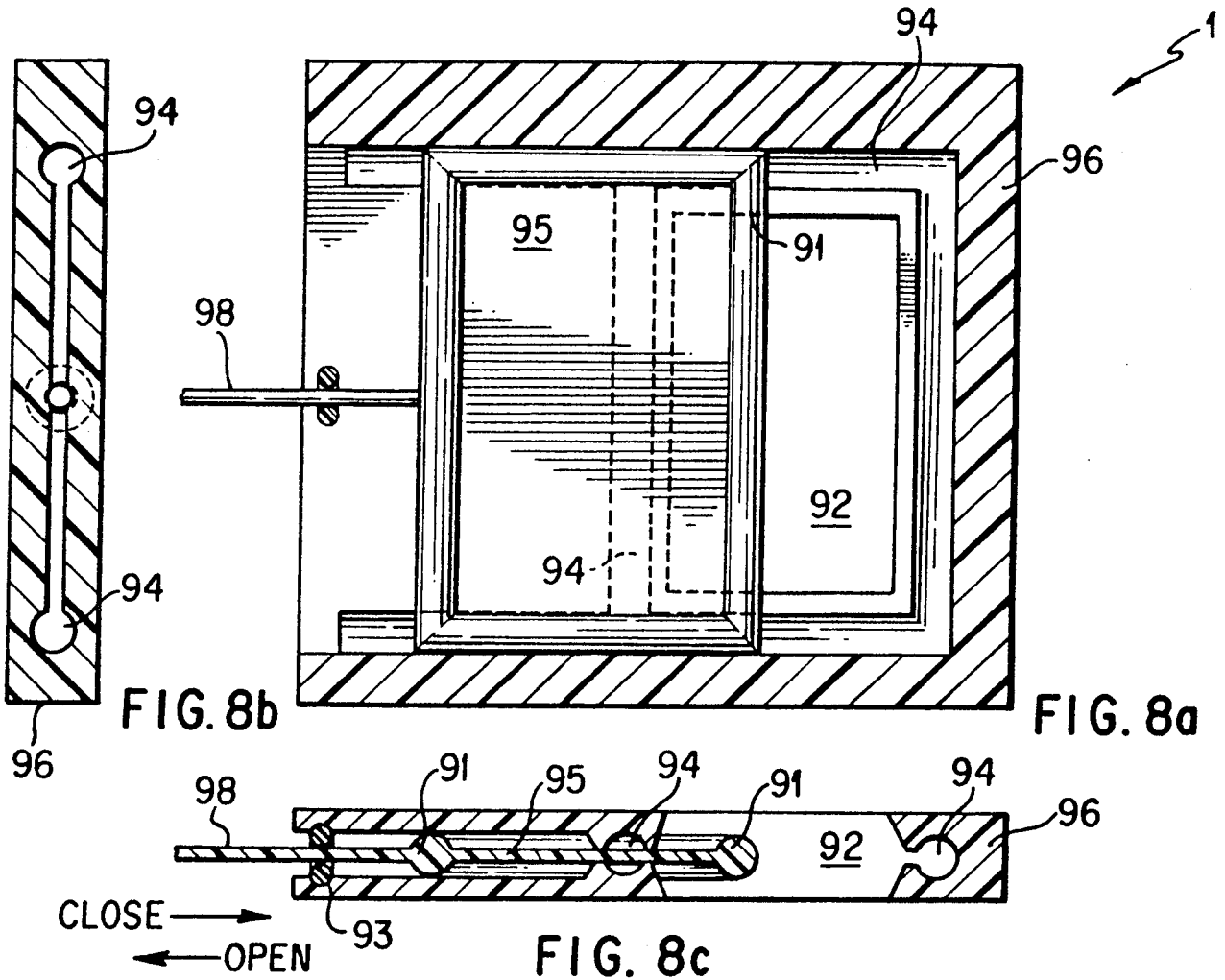
FIGS. 8(*a*), 8(*b*), and 8(*c*), are a top view, a cross-sectional front view, and a side view, respectively, of an alternate embodiment of a movable panel which is disposed in the toner cartridge and which can be slid open to permit toner to exit the toner cartridge and to enter the toner hopper or slid closed to seal the toner in the toner cartridge.

FIGS. 8(*a*) through 8(*c*) illustrate an alternate embodiment of a movable panel included in the toner cartridge 1. Once the toner cartridge 1 is sealed onto the toner hopper 2, permitting toner to flow from the toner cartridge 1 to the toner hopper 2 is desired.

FIG. 8(*a*) illustrates a top view of a bottom surface of the toner cartridge 1. This bottom surface includes a peripheral area 96 defining an opening 92 and a movable panel, and in particular, a slidable panel 95 having a handle 98. As can be seen from FIG. 8(*a*), when the handle 98 is manually pushed in toward the toner cartridge 1, the sliding panel 95 covers the opening 92. As shown in FIGS. 8(*a*) through 8(*c*), the peripheral area 96 includes female locking surfaces 94 while the sliding panel 95 includes corresponding male locking surfaces 91, such that when the sliding panel 95 covers the opening 92, the male locking surfaces 91 lock into the female locking surfaces 94 thereby forming a positive seal.

Once the toner cartridge 1 is sealed onto the top of the toner hopper 2, releasing the toner from the toner cartridge 1 to the toner hopper 2 is desired. To achieve this, the handle 98 is pulled away from the toner cartridge 1 such that the sliding panel 95 uncovers the opening 92. As shown in FIG. 8(*c*), the side of the peripheral area from which the handle 98 projects includes O-rings 93.

Additional advantages and modifications will readily occur to those skilled in the art. Therefore, the present invention with its broader aspects is not limited to the specific details, representative apparatus, and illustrative examples shown and described. Accordingly, departures may be made from such details and examples without departing from the spirit of scope of the general inventive concept as defined by the claims and their equivalents.

What is claimed is:

1. A toner cartridge, for use with a copier having a toner hopper with a first interlocking sealing means, comprising:

a) a plurality of side walls forming a cavity adapted to hold toner;

b) a second interlocking sealing means, said second interlocking sealing means, i) being formed on a bottom portion of each of said plurality of side walls, and ii) being specially adapted to interlock with said first interlocking sealing means of said toner hopper;

c) a movable panel, said movable panel being disposed at the bottom portion of the toner cartridge;

d) a hinge, said hinge adapted to pivotally attach said movable panel to a bottom portion of one of said plurality of side walls;

e) means for sealing said movable panel; and f) a long, thin, flexible member, said long, thin, flexible member having a first end attached to said movable panel and a second end exiting through an opening in said toner cartridge.

2. The toner cartridge of claim 1 wherein said first end of said long, thin, flexible member is attached to said movable panel at a point opposite said hinge.

3. The toner cartridge of claim 1 wherein said means for sealing said movable panel includes sealing tape, and a filament disposed beneath said sealing tape.

4. The toner cartridge of claim 3 wherein said filament is an integral part of said long, thin, flexible member.

5. The toner cartridge of claim 1 wherein said means for sealing said movable panel includes sealing tape, said sealing tape having one end exiting through a slit in said toner cartridge.

6. The toner cartridge of claim 1 wherein said first interlocking sealing means and said second interlocking sealing means have substantially flat, parallel surfaces.

7. The toner cartridge of claim 1 wherein said first interlocking sealing means and said second interlocking sealing means are formed of soft poly-vinyl-chloride.

8. The toner cartridge of claim 1 wherein said first interlocking sealing means and said second interlocking sealing means have substantially flat, parallel surfaces and are formed of soft poly-vinyl-chloride.

9. The toner cartridge of claim 1 wherein said first interlocking sealing means is a mount interlocking sealing means and said second interlocking sealing means is a groove interlocking sealing means.

10. The toner cartridge of claim 1 wherein said first interlocking sealing means is a groove interlocking sealing means and said second interlocking sealing means is a mount interlocking sealing means.

11. The toner cartridge of claim 3 wherein a portion of said filament exiting through said opening is affixed to an outside surface of said toner cartridge.

12. A toner cartridge, for use with a copier having a toner hopper with a first interlocking sealing means, comprising:

a) a plurality of side walls forming a cavity adapted to hold toner;

b) a second interlocking sealing means, said second interlocking sealing means,
   i) being formed on a bottom portion of each of said plurality of side walls, and
   ii) being specially adapted to mate with said first interlocking sealing means of said toner hopper;
c) a plurality of movable panels, said plurality of movable panels being disposed at the bottom portion of the toner cartridge;
d) a hinge, said hinge adapted to pivotally attach at least one of said plurality of movable panels to a bottom portion of said toner cartridge;
e) a means for sealing said plurality of movable panels;
f) a long, thin, flexible member, said long, thin, flexible member having a first end and a second end exiting through an opening in said toner cartridge; and
g) a plurality of filament segments, each having a first end attached to said first end of said long, thin, flexible member and a second end attached to a corresponding one of said plurality of movable panels.

13. The toner cartridge of claim 12 wherein each of said first ends of said plurality of filament segments is attached to a corresponding one of said plurality of movable panels at a point opposite said hinge.

14. The toner cartridge of claim 12 wherein said means for sealing said plurality of movable panels includes,
   i) sealing tape, and
   ii) a second filament disposed beneath said sealing tape.

15. The toner cartridge of claim 14 wherein said second filament is an integral part of said long, thin, flexible member.

16. The toner cartridge of claim 12 wherein said means for sealing said plurality of movable panels includes sealing tape said sealing tape having one end exiting through a slit in said toner cartridge.

17. The toner cartridge of claim 12 wherein said first interlocking sealing means and said second interlocking sealing means have substantially flat, parallel surfaces.

18. The toner cartridge of claim 12 wherein said first interlocking sealing means and said second interlocking sealing means are formed of soft poly-vinyl-chloride.

19. The toner cartridge of claim 12 wherein said first interlocking sealing means and said second interlocking sealing means have substantially flat, parallel surfaces and are formed of soft poly-vinyl-chloride.

20. The toner cartridge of claim 12 wherein a portion of said long, thin, flexible member exiting through said opening is affixed to an outside surface of said toner cartridge.

21. The toner cartridge of claim 12 wherein said first interlocking sealing means is a mount interlocking sealing means and said second interlocking sealing means is a groove interlocking sealing means.

22. The toner cartridge of claim 12 wherein said first interlocking sealing means is a groove interlocking sealing means and said second interlocking sealing means is a mount interlocking sealing means.

23. A method for installing a toner cartridge including a plurality of side walls forming a cavity adapted to hold toner, a first interlocking sealing means, said first interlocking sealing means being formed on a bottom portion of each of said plurality of side walls, a movable panel being disposed at the bottom portion of the toner cartridge, a hinge adapted to pivotally attach said movable panel to a bottom portion of one of said plurality of side walls, a means for sealing said movable panel and a filament having a first end attached to said movable panel and a second end exiting through an opening in said toner cartridge onto a toner hopper having a second interlocking sealing means comprising steps of:
a) mounting said toner cartridge onto said toner hopper so as to interlock said second interlocking sealing means with said first interlocking sealing means;
b) removing said means for sealing said movable panel; and
c) manipulating said second end of said filament so as to permit said movable panel to pivot about said hinge toward said toner hopper.

24. The method of claim 23 wherein once said toner cartridge is installed onto said toner hopper, said toner cartridge may be removed by:
a) manipulating said second end of said filament so as to pivot said movable panel about said hinge away from said toner hopper; and
b) dismounting said toner cartridge so as to unlock said second interlocking sealing means and said first interlocking sealing means.

25. An arrangement comprising:
a) a toner cartridge, said toner cartridge including:
   i) a plurality of side walls, said plurality of side walls
      including two opposing side walls, and
      defining a bottom opening; and
   ii) an axis, said axis
      extending between said two opposing side walls slightly above the bottom opening; and
   iii) a movable panel, said movable panel
      adapted to rotate about said axis, and
      having an opened state and a closed state; and
b) a toner hopper, said toner hopper
   adapted to receive said toner cartridge, and
   including a mechanical interlock, said mechanical interlock
      including
         an axial portion,
         a first rod extension, and
         a second rod extension, said second rod extension being longer than said first rod extension, and
      having a first state and a second state wherein, when said toner hopper receives said toner cartridge and when said mechanical interlock is in said first state, said first rod extension contacts said movable panel such that said movable panel assumes said closed state, and wherein, when said toner hopper receives said toner cartridge and when said mechanical interlock is in said second state, said second rod extension contacts said movable panel such that said movable panel assumes said opened state.

26. The arrangement of claim 25 wherein said axial portion of said mechanical interlock is substantially perpendicular to both said first rod extension and said second rod extension.

27. The arrangement of claim 26 wherein said first rod extension is substantially perpendicular to said second rod extension.

28. The arrangement of claim 25 wherein said movable panel includes
   an upper section, a lower section, parallel yet non-coplanar with said upper section, and a middle section, connecting said upper and lower sections and accommodating said axis.

29. The arrangement of claim 28 wherein when said toner hopper receives said toner cartridge and when said mechanical interlock is in said first state, said first rod extension contacts said lower section of said movable panel such that said movable panel assumes said closed state, and wherein when said toner hopper receives said toner cartridge and when said mechanical interlock is in said second state, said second rod extension contacts said upper section of said movable panel such that said movable panel assumes said opened state.

30. The arrangement of claim 29 wherein one of said two opposing side walls is located adjacent to said lower section of said movable panel, and includes a protrusion contacting a region of a top surface of said lower section of said movable panel when said movable panel is in said closed state.

31. An arrangement comprising:

a) a toner cartridge including a bottom interlock section, said bottom interlock section including, i) a first rectangular extension having an outer length and width, and ii) a first rectangular flange, located adjacent to, and along the outer periphery of said first rectangular extension; and b) a toner hopper, said toner hopper i) adapted to receive said toner cartridge, and ii) including a top interlock section, said top interlock section including, a second rectangular extension having an inner length and width substantially equal to said outer length and width, respectively, of said first rectangular extension, and a second rectangular flange, located adjacent to, and along the inner periphery of said second rectangular extension.

32. The arrangement of claim 31 wherein a cross-sectional width of said first rectangular extension increases as the extension extends from said first rectangular flange and wherein a cross-sectional width of said second rectangular extension increases as the extension extends from said second rectangular flange.

33. The arrangement of claim 32 wherein a cross-section of said first rectangular extension forms a radius of curvature $R_1$ with said first rectangular flange and a cross section of an outer side of said first rectangular extension forms a radius of curvature $R_2$ with a bottom of said first rectangular extension and wherein a cross-section of said second rectangular extension forms a radius of curvature $R_3$ with said second rectangular flange and a cross section of an inner side of said second rectangular extension forms a radius of curvature $R_4$ with a bottom of said second rectangular extension.

34. The arrangement of claim 33 wherein $R_1$ is approximately equal to $R_3$ and $R_2$ is approximately equal to $R_4$.

35. The arrangement of claim 34 wherein at least one of said top and bottom interlock sections is formed of soft poly-vinyl-chloride.

36. The arrangement of claim 34 wherein at least one of said top and bottom interlock sections is formed of low density polyethylene.

37. The arrangement of claim 34 wherein at least one of said top and bottom interlock sections is formed of rubber.

38. The arrangement of claim 31 where in said toner hopper further includes means for clamping, said means for clamping having an un-clamped state and a clamped state in which said means for clamping clamps said first rectangular flange to said top interlock section.

39. An arrangement comprising:

a) a toner cartridge, said toner cartridge i) adapted to hold toner, ii) including a first interlocking sealing means, and iii) including a movable panel having an open state and a closed state;

b) a toner hopper, said toner hopper i) including a second interlocking sealing means adapted to form a sealed toner pathway with said first sealing means; and c) a means for changing a state of said movable panel.

40. The arrangement of claim 39 wherein said means for changing is located in said toner cartridge and wherein said movable panel is hinged to a portion of said toner cartridge.

41. The arrangement of claim 39 wherein said movable panel is rotatable about an axial rod and wherein said means for changing is located in said toner hopper.

42. A toner cartridge adapted to hold toner comprising:

a) a plurality of side walls forming a cavity adapted to hold said toner; and b) a bottom surface, said bottom surface including, i) a peripheral area defining an opening and including female locking surfaces, ii) a movable panel, said movable panel having an open state in which said toner is permitted to flow through said opening and a closed state in which said toner is held within the toner cavity.

43. The toner cartridge of claim 42 wherein said movable panel includes male locking surfaces adapted to form a seal with said female locking surfaces when said movable panel is in said closed state.

44. The toner cartridge of claim 43 wherein said movable panel further includes a handle adapted to permit manual manipulation of the movable panel from said open state to said closed state and from said closed state to said open state.

* * * * *